United States Patent [19]

Hardwick et al.

[11] Patent Number: 5,052,359

[45] Date of Patent: Oct. 1, 1991

[54] AUTOMATIC ENGINE FUEL ENRICHMENT AND IGNITION ADVANCE ANGLE CONTROL SYSTEM

[75] Inventors: Ralph G. Hardwick; William C. Eberline; Matthew L. Werner, all of Cass City; James K. Miller, Ann Arbor, all of Mich.

[73] Assignee: Walbro Corporation, Cass City, Mich.

[21] Appl. No.: 385,676

[22] Filed: Jul. 26, 1989

[51] Int. Cl.[5] ..... F02D 41/06; F02D 43/00; F02P 5/15

[52] U.S. Cl. ..... 123/418; 123/424; 123/179 G; 123/180 E; 123/180 T

[58] Field of Search ..... 123/179 G, 179 L, 491, 123/180 E, 180 T, 424, 418

[56] References Cited

U.S. PATENT DOCUMENTS

| | | | |
|---|---|---|---|
| 4,184,460 | 1/1980 | Harada et al. | 123/491 |
| 4,259,934 | 4/1981 | Leussink et al. | 123/424 |
| 4,326,486 | 4/1982 | Mezger et al. | 123/418 |
| 4,432,325 | 2/1984 | Auracher et al. | 123/179 G |
| 4,480,618 | 11/1984 | Kamifuji et al. | 123/179 G |
| 4,489,691 | 12/1984 | Ono et al. | 123/424 |
| 4,528,963 | 7/1985 | Bessho et al. | 123/491 |
| 4,644,919 | 2/1987 | Inoguchi et al. | 123/179 G |

FOREIGN PATENT DOCUMENTS

| | | | |
|---|---|---|---|
| 2612256 | 9/1988 | France | 123/424 |
| 60-156979 | 8/1985 | Japan | 123/418 |

*Primary Examiner*—Andrew M. Dolinar

*Attorney, Agent, or Firm*—Barnes, Kisselle, Raisch, Choate, Whittemore & Hulbert

[57] ABSTRACT

An automatic fuel enrichment system for cranking and warm-up of an internal combustion engine in which a solenoid valve is responsive to control electronics for selectively feeding enrichment fuel to the engine air intake manifold. The valve control electronics receives a signal from the engine ignition system and controls a solenoid valve as a function of engine speed. Specifically, the control electronics energizes the solenoid valve when engine speed exceeds a preset minimum cranking threshold until the engine reaches a preset idle speed threshold, at which point enrichment is terminated. In the event that the engine begins to stall during warm-up and engine speed declines to a preset intermediate threshold, the enrichment valve is again energized until the engine reaches idle speed.

31 Claims, 4 Drawing Sheets

AUTOMATIC ENGINE FUEL ENRICHMENT AND IGNITION ADVANCE ANGLE CONTROL SYSTEM

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

The present invention is directed to fuel delivery and ignition control systems for internal combustion engines, and more particularly to a system for automatically enriching the fuel/air mixture and/or controllably retarding ignition advance angle of ar internal combustion engine to assist cranking (starting) and warm-up of the engine.

BACKGROUND AND OBJECTS OF THE INVENTION

Cold-starting and warm-up of internal combustion engines, particularly small engines in chainsaws, snowblowers, outboard marine engines and the like, have been and remain a problem in the art. In one system heretofore proposed, a solenoid valve is responsive to an operator manual key-switch or pushbutton prior to cranking or starting to feed fuel from a tank or supply to the air intake manifold to enrich the fuel/air mixture upstream of the engine carburetor. After the engine starts and begins to run, if the engine appears to be stalling, the operator must again activate the switch for a short period of time to re-enrich the fuel/air mixture and prevent stalling. Such operator-controlled enrichment systems require operator attention and intervention to enrich the fuel/air mixture for starting and to prevent stalling during warm-up. Further, there is the distinct possibility of over-enriching the fuel-air mixture and thereby flooding the engine.

Thus, there is a need for an automatic engine enrichment system for use with internal combustion engines of the described character that does not require operator intervention, and thus is independent of training and attention of the operator, that is automatically responsive to engine operation for selectively enriching the fuel/air mixture during both cranking and warm-up, that is economical to implement, that is reliable over an extended operating lifetime, and that requires minimum adaptation to particular engine designs and requirements. It is an object of the present invention to provide an automatic engine fuel enrichment system of the described character that satisfies some or all of the aforementioned deficiencies in the art.

Another object of the present invention is to provide system for controlling engine advance angle so as to assist engine operation and prevent stalling during both warm-up and normal operation.

SUMMARY OF THE INVENTION

An automatic fuel enrichment system for cranking and warm-up of an internal combustion engine in accordance with one aspect of the present invention includes a fuel supply, a solenoid valve responsive to application of electrical power for selectively feeding enrichment fuel from the supply to the engine, and automatic control circuitry responsive to engine operation for selectively energizing and de-energizing the solenoid valve, and thereby feeding enrichment fuel from the supply to the engine, as a predetermined function of engine operation. In particular, the valve-control circuitry is responsive to engine r.p.m. for selectively operating the solenoid valve during cranking as the engine speed increases and during warm-up in the event that engine speed decreases sufficiently to indicate an impending stall. In accordance with the preferred embodiments of the invention, engine speed is compared to a first threshold that may correspond to minimum cranking speed of the engine, for energizing the solenoid valve and enriching the fuel/air mixture during cranking, to a second threshold that may correspond to (preferably slightly less than) idle speed of the engine for de-energizing the solenoid valve and terminating delivery of cranking enrichment fuel, and to a third threshold corresponding to an engine speed between the minimum cranking and idle speeds for re-energizing the solenoid valve and feeding enrichment fuel to the engine to prevent engine stall during warm-up.

In one embodiment of the invention, engine speed is measured by monitoring engine ignition signals. A pulse is generated in response to each ignition signal and directed to a frequency-to-voltage convertor for providing a d.c. analog signal that varies with engine speed. Specifically, the frequency-to-voltage converter includes a sawtooth signal generator having a reset input responsive to the speed signal pulses for providing a ramping output signal that varies as a function of time duration between the resetting signal pulses. A sample-and-hold circuit samples peak values of the ramp signal and supplies such peak values as the analog speed signal. In a preferred second embodiment of the invention, the engine r.p.m. input pulses are fed to a microprocessor-based controller to initiate an interrupt routine in which engine speed is calculated and the solenoid valve is energized as a function of absolute value and changes in engine speed as previously described. In addition, the digital embodiment of the invention includes facility for selectively and/or automatically controlling ignition advance angle at the engine as a function of engine speed during engine warm-up or following an impending stall condition.

In accordance with a second aspect of the present invention, a system for controlling ignition advance angle of an internal combustion engine having ignition advance control facility includes control circuitry responsive to a decrease in engine speed below a preselected threshold and coupled to the engine ignition advance angle control for automatically decreasing advance angle at the engine ignition. Preferably, such circuitry is also responsive to a subsequent increase in engine speed above the threshold automatically to increase engine advance angle at the engine advance control module. In the preferred embodiment of the invention, such ignition advance angle increase and/or decrease is accomplished in discrete steps upon each revolution of the engine. The ignition advance angle control preferably is microprocessor-based.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
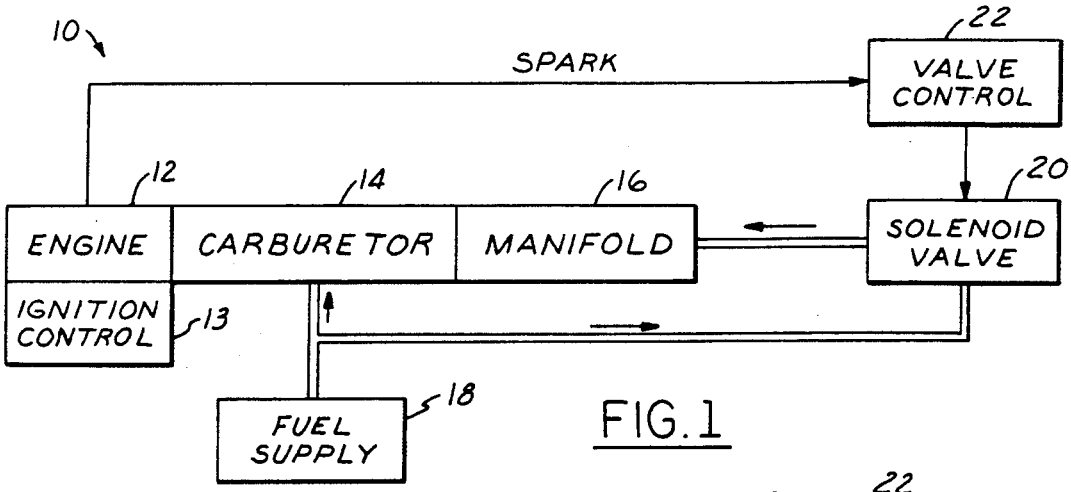
FIG. 1 is a functional block diagram of an automatic engine fuel enrichment system in accordance with one embodiment of the invention.

FIG. 1 illustrates an engine fuel delivery system 10 in accordance with one embodiment of the invention as including an engine 12 having an ignitor control 13 and a carburetor 14 with an air intake manifold 16 coupled thereto. A fuel supply 18 feeds fuel to carburetor 14 for mixing with air from manifold 16 in the usual manner, and for delivery of such fuel/air mixture to the cylinder or cylinders of engine 12. In accordance with the present invention, a solenoid valve 20 receives a fuel input from supply 18 and supplies enrichment fuel to manifold 16 under control of valve control electronics 22. Valve control electronics 22 receives a control input from the ignition system of engine 12. Enrichment fuel delivered to manifold 16 by valve 20 may be dripped, sprayed or otherwise injected into the airstream passing through manifold 16 in any of the usual and conventional fuel enrichment configurations.

Figure 2:
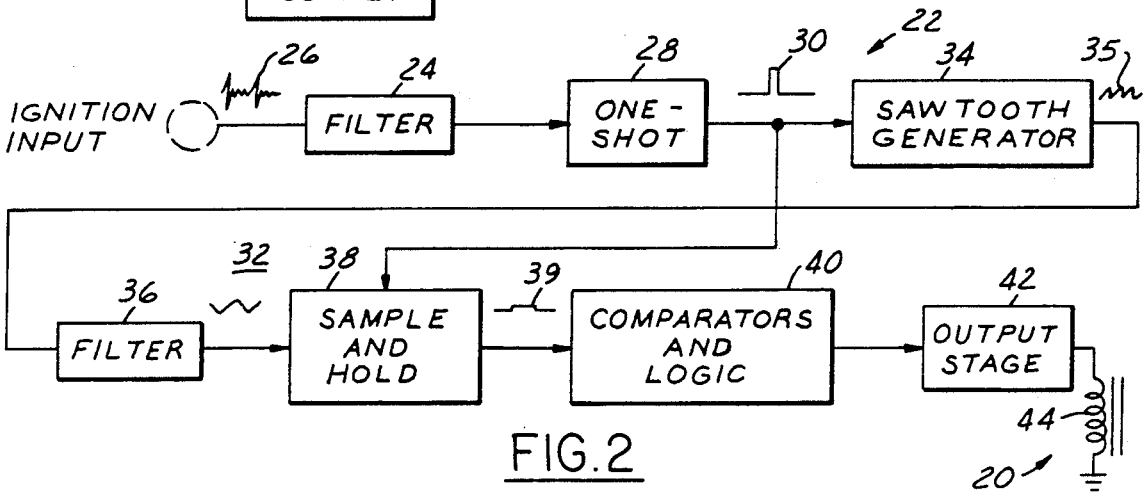
FIG. 2 is a more detailed functional block diagram of the solenoid valve control circuit in FIG. 1.

FIG. 2 illustrates valve control electronics 22 in greater detail. A filter 24 receives an input signal 26 from the ignition system of engine 12, such as from the primary side of the engine ignition transformer (not shown). A one-shot 28 receives the output of filter 24 and supplies a clean signal pulse 30 responsive to each ignition pulse in signal 26. The output of one-shot 28 drives a frequency-to-voltage converter 32 that includes a sawtooth signal generator 34, a buffer/filter 36 and a sample-and-hold circuit 38. In particular, the output of one-shot 28 is connected to the reset input of generator 34. The output 35 of generator 34 consists of a series of linearly increasing ramp signals, with the peak voltage obtained by each ramp signal corresponding to the time duration between associated successive reset inputs, and thus corresponding to time duration between successive ignition pulses 30. Such ramp signal 35 is filtered at 36 and then directed to the signal input of sample-and-hold circuit 38, which receives a control input from one-shot 28.

The output of sample-and-hold circuit 38 supplies a d.c. analog signal that corresponds to peak voltage at generator 34 between the immediately preceding successive ignition pulses 30. The output of circuit 38 is thus updated upon occurrence of each ignition pulse, and provides a direct indication of ignition r.p.m. as a function of time duration between ignition pulses. The output of sample-and-hold circuit 38 is fed to comparator and control logic 40, and thence through an output amplifier stage 42 to the coil 44 of solenoid valve 20 (FIGS. 1 and 2).

Figure 3:
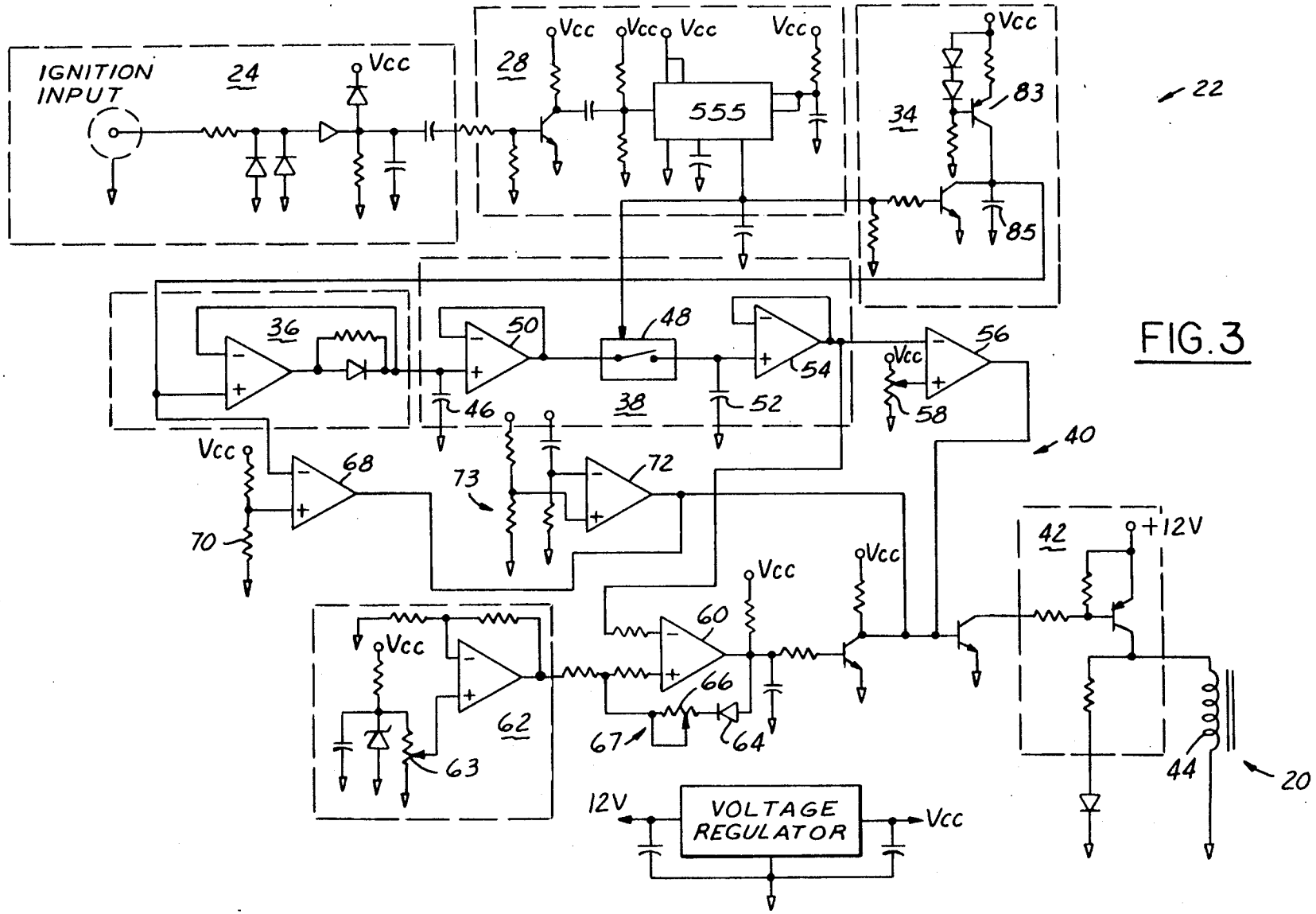
FIG. 3 is an electrical schematic diagram of the valve control circuit illustrated in functional block form in FIGS. 1 and 2.

FIG. 3 illustrates valve control circuit 22 (FIGS. 1 and 2) in greater detail, with the individual functional blocks of FIG. 2 being correspondingly identified in FIG. 3. Filter 24 and one-shot 28 are of generally conventional construction. Generator 34 includes a constant current source 83 to assure linearity of ramp signal output 35 (FIG. 2) appearing across the capacitor 85. Sample-and-hold (s/h) circuit 38 includes a first capacitor 46 that receives the output of buffer/filter 36. A controlled electronic switch 48 has an input connected across capacitor 46 through a unity-gain amplifier 50, and an output connected across a signal-holding capacitor 52. Capacitor 52 is connected to a unity-gain buffer amplifier 54 for supplying the output of s/h circuit 38. The control input of switch 48 receives output 30 (FIG. 2) of one-shot 28.

Comparator and logic circuit 40 includes a first comparator 56 for comparing the output of amplifier 54 to a first threshold determined by an adjustable resistor 58. A second comparator 60 receives a first input from s/h amplifier 54, and a second input at controlled voltage from a reference compensation circuit 62. The reference level of circuit 62 is determined in part by an adjustable resistor 63. The output of comparator 60 is connected to the reference input thereof through a diode 64 and an adjustable resistor 66. Comparator 60, diode 64 and resistor 66 thus comprise a Schmitt trigger 67 having first and second threshold levels, and hysteresis therebetween, determined by resistor 66 and the reference voltage input from circuit 62. A third comparator 68 receives a signal input from generator 34 and a reference input from a voltage divider 70. A fourth comparator 72 is connected to delay circuitry 73 for inhibiting operation when the unit is initially powered up. The outputs of comparators 56, 60, 68, 72 are connected together or wire-ORed, as the output of logic 40, to the input of solenoid drive amplifier 42, and thence to coil 44 of solenoid valve 20 as previously described.

Figure 4:
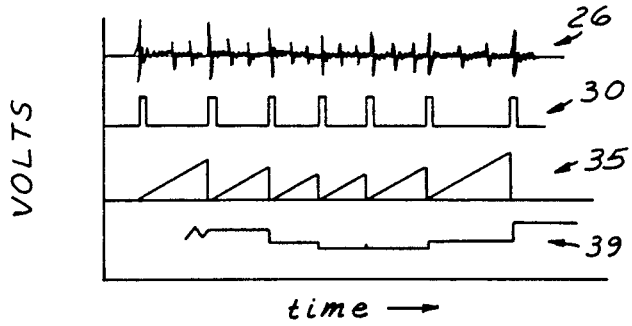
FIGS. 4 and 5 are graphic illustrations useful in explaining operation of the embodiment of the invention illustrated in FIGS. 2–3.

Operation of of the invention is illustrated graphically in FIGS. 4 and 5, and will be described in detail in connection therewith. Specifically, FIG. 4 illustrates the relationship between signals 26, 30, 35, 39 on a common time base. One shot 28 (FIGS. 2 and 3) generates a pulse 30 of controlled and stable time duration upon occurrence of each ignition signal 26, with filter 24 (FIGS. 2 and 3) discriminating between true ignition signals and spurious noise. Each pulse 30 resets ramp signal 35, with the ramp signal thereafter increasing linearly with time. Each pulse 30 also resets s/h circuit 38 (FIGS. 2 and 3), whose output 39 at any point in time corresponds to time duration between successive immediately preceding pulse 30.

Figure 5:
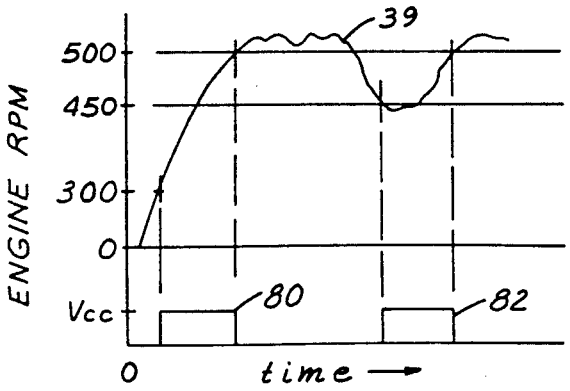

FIG. 5 illustrates operation of the invention in connection with a specific engine having a minimum cranking speed of 300 r.p.m. and a nominal idle speed of slightly more than 500 r.p.m. (The foregoing and all other specific speed settings are by way of example only.) Thus, the threshold set by resistor 58 (FIG. 3) is at an output voltage 39 corresponding to an engine speed of 300 r.p.m., and the threshold set by resistor 63 is at a level corresponding to an engine speed of 500 r.p.m.. The hysteresis of trigger 67, and thus the intermediate threshold, is set by resistor 66 of Schmitt trigger 67 at 450 r.p.m., which corresponds to a threshold empirically determined for each engine, at which the fuel/air mixture must be enriched to prevent stalling during warm-up. As the engine is initially cranked, when engine speed reaches the 300 r.p.m. threshold of comparator 56, solenoid valve 20 is energized as illustrated at 80 (FIG. 5), so as to feed enrichment fuel to the engine manifold. It will be appreciated that such enrichment fuel feed is parallel to and independent of primary fuel feed from supply 18 directly to carburetor 14. The solenoid valve remains energized, and enrichment fuel is supplied to the engine manifold, until engine speed reaches the idle speed of 500 r.p.m., at which time the solenoid valve is de-energized and enrichment fuel supply is terminated.

In the event that the engine begins to stall during warm-up, and engine velocity decreases to the threshold level of 450 r.p.m. detected at trigger 67, valve 20 is again energized as illustrated at 82 (FIG. 5) and remains energized until engine speed again reaches the 500 r.p.m. idle threshold. Thus, enrichment fuel is automatically supplied only during periods in which such fuel is required to assist starting and to prevent stall during warm-up. Comparator 68 prevents supply of enrichment fuel when the engine has stalled, and thus helps prevent flooding. Comparator 72 prevents supply of enrichment fuel when the system is initially turned on to prevent any preignition from activating the solenoid valve. In commercial embodiments of the invention, adjustable resistors 58, 63, 66 are replaced by voltage dividers empirically selected for each engine configuration.

Figure 6A:
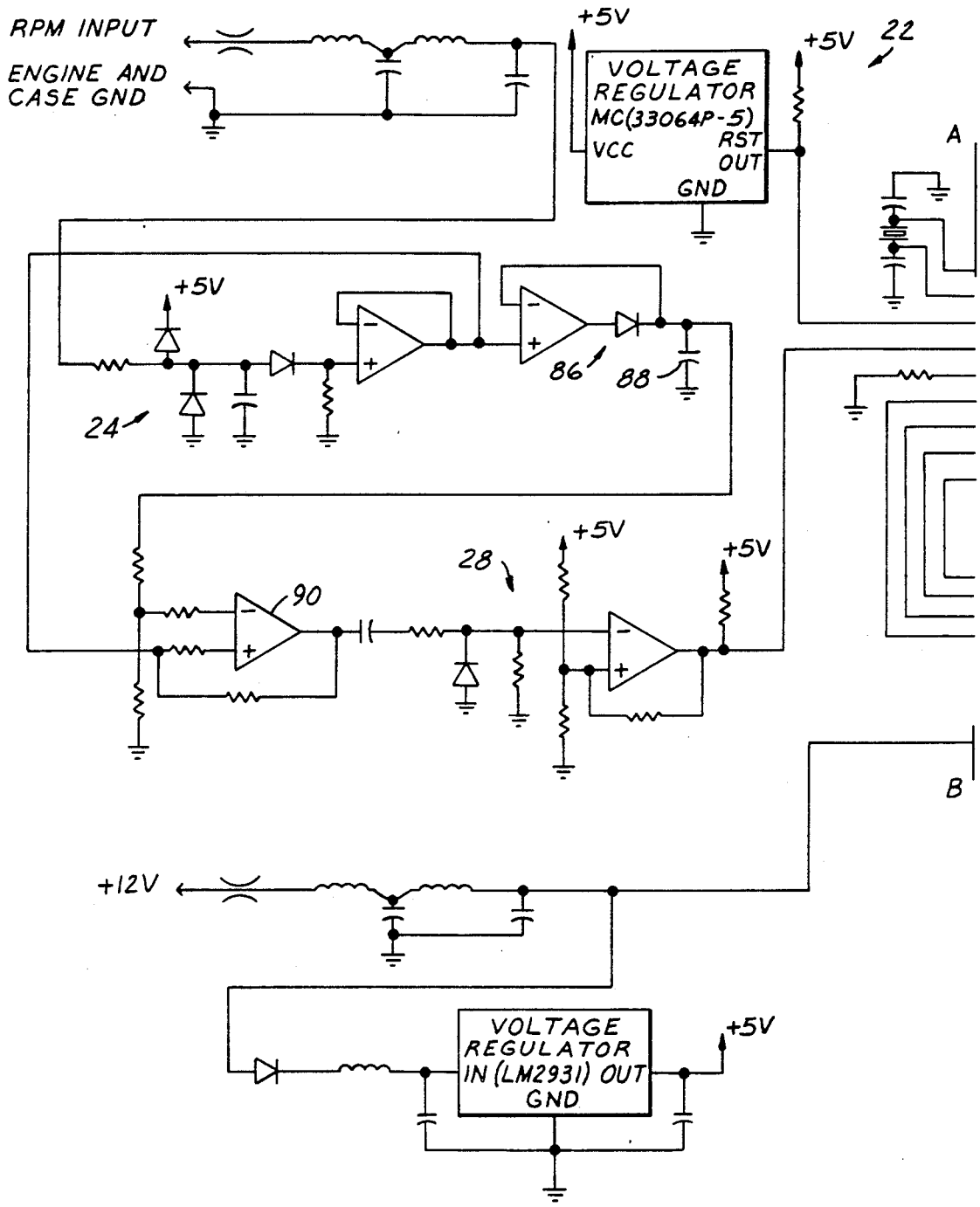
FIGS. 6A and 6B together comprise an electrical schematic diagram of a digital embodiment of the automatic control system in accordance with the invention.
Figure 6B:
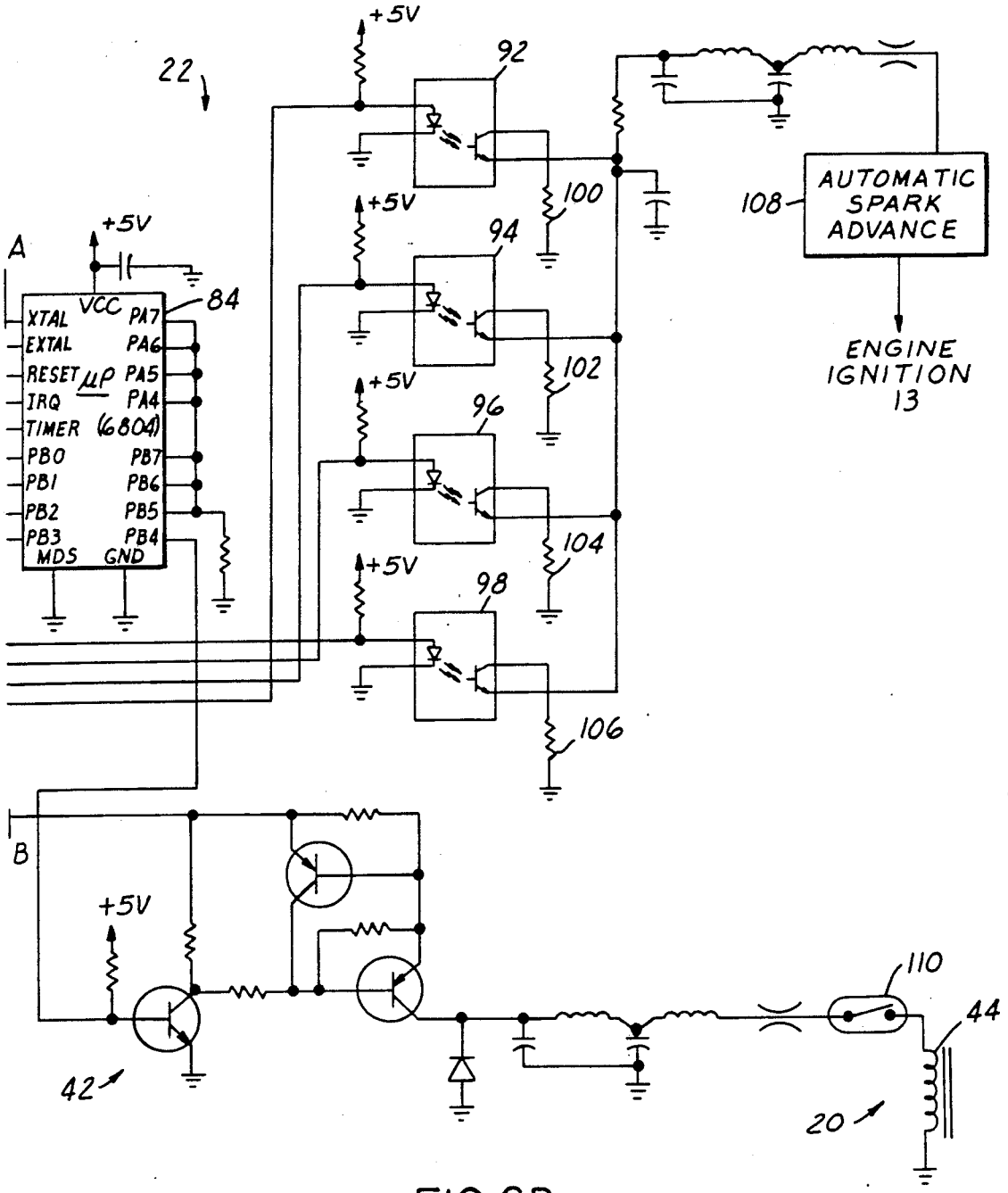

FIGS. 6A and 6B, interconnected along the line A-B in each figure, illustrate a presently preferred digital embodiment of valve control electronics 22 that features a microprocessor 84 suitably programmed to obtain fuel enrichment control as previously described, as well as ignition advance angle control as will be described. The output of lowpass filter 24 is fed to a peak detector 86 that establishes across a capacitor 88 a d.c. voltage level indicative of running speed of the engine. The output of filter 24 is also connected to one input of a comparator 90 that receives a second input from capacitor 88, with the output of comparator 90 feeding one-shot 28. One-shot 28 thus feeds a pulsed signal indicative of engine speed to the IRQ input of microprocessor 84 for initiating a speed-calculation interrupt routine. The PB7 port of microprocessor 84 is connected to output amplifier stage 42 for energizing coil 44 of solenoid valve 20 through a temperature-sensitive switch 110. Switch 110 is mounted on engine 12 (FIG. 1), and opens the connection between between amplifier 42 and coil 44 when the engine is warm. The PB0–PB3 ports of microprocessor 84 are connected to respective optical couplers 92, 94, 96, 98 for selectively controlling placement of resistors 100, 102, 104, 106 in parallel with each other at the control input of an automatic ignition advance control system 108. The output of system 108 is connected to ignition control 13 (FIG. 1) for controlling ignition advance angle.

Operation of the embodiment FIGS. 6A and 6B will be described in conjunction with one presently preferred implementation thereof, for which suitable microprocessor control programming is attached hereto as an Appendix. During an initial warm-up period of approximately forty seconds duration, both enrichment fuel and ignition advance angle control take place, whereas after the initial warm-up period, only ignition advance control is obtained and the fuel enrichment feature is not employed. However, the warm-up period is not time-based—i.e., a forty second time measurement—but is based upon the number of revolutions that the engine has turned since cranking. The number of revolutions in the exemplary implementation of the invention is 512, which corresponds to forty seconds of engine operation at an average speed of 768 r.p.m. Thus, if the engine is running faster than the assumed average, the warm-up period is correspondingly shorter in time. It has been found that the number of revolutions of the engine provides a more accurate measure of engine warm-up temperature than does strict time-based measurement.

During the initial warm-up period, the engine speed is controlled first with the ignition advance control circuitry and then by fuel enrichment. For advance control purposes, the initial warm-up period is divided into two intervals, the first consisting of the first 160 engine revolution of the warm-up period and the second consisting of the remaining 352 revolutions of the warm-up period. During the first interval, the low speed first threshold in this exemplary implementation of the invention is 710 r.p.m., and the high-speed second threshold is 1125 r.p.m. When engine speed falls below 710 r.p.m., advance angle is increased by one step upon each revolution of the engine. On the other hand, when engine speed is above the 1125 r.p.m. threshold, the advance angle is decreased by one step for each engine revolution. There are sixteen steps to the advance control from zero to full advance. In one preferred implementation of the invention, these discrete steps correspond to an advance angle of zero to eight degrees. During the 352 revolution second interval, the low and high thresholds are changed to 660 r.p.m. and 760 r.p.m. respectively, and operation is otherwise the same as during the first interval.

The engine speed thresholds at which fuel enrichment takes place during the initial warm-up period depend upon previously-obtained engine speed. That is, in the exemplary embodiment of the invention, if the engine has previously operated above 800 r.p.m., enrichment thresholds of 525 and 625 r.p.m. are employed—i.e., fuel enrichment takes place when engine speed falls below 525 r.p.m. and terminates when engine speed exceeds 625 r.p.m. However, if engine speed has fallen below 570 r.p.m. these thresholds are changed to 520 and 600 r.p.m. respectively.

After the 512 revolution warm-up period, the advance control points change, and fuel enrichment is terminated. The advance angle lower threshold limit is reset to 610 r.p.m., and higher limit is reset to 660 r.p.m. Advance control continues to function in the same manner as previously described. If microprocessor 84 does not receive ignition pulses for a period of time, the microprocessor assumes that the engine has stalled and turns off the advance and fuel enrichment control functions. This time duration corresponds to the time between pulses when the engine speed is at 280 r.p.m., approximately 0.21 seconds. It can be assumed that the engine will not continue to run if it reaches this speed.

The warm-up period, including fuel enrichment, is reinstated if the engine stalls. However, if the engine is already warm, fuel enrichment will not take place because temperature switch 110 will be open. This helps prevent flooding of a warm engine. In one working embodiment of the invention, switch 110 opens at a temperature of 120° F., and closes at a temperature of 95° F. After a stall, ignition advance control takes place for the first 512 revolutions as previously described.

In accordance with another feature of the invention, when the operator operates the engine at high speed before the initial warmup period has expired, the fuel enrichment control is disabled and the advance control levels are set to the normal operating point as if the warmup period had expired. The engine speed must be greater than 1680 r.p.m. for at least eight engine revolutions for this feature to be activated.

Appendix

```
0002                    opt l
0003                    ************************************************************************
0004                    ****    FILE:mercgov.asm          Mercury EZ-Start                   ****
0005                    ************************************************************************
0006                    *
0007                    ************************************************************************
0008                    *                                                                      ****
0009                    *    (C) Copyright 1989 Walbro Corporation, Cass City, Michigan        ****
0010                    *                                                                      ****
0011                    ************************************************************************
0012                    *
0013                    * ABSTRACT
0014                    * --------              Brief Description of Program
0015                    *
0016                    *        This program is designed to run on a Motorola 68704
0017                    *       microcomputer.It controls a fuel enrichment valve
0018                    *       (solenoid valve) for engine enrichment and spark ad-
0019                    *       vancement on a Mercury Marine engine.
0020                    *
0021                    *       Upon power up the micro initializes all of the ports
0022                    *       for output and maintains both solenoid and spark ad-
0023                    *       vance off. It automatically starts timing thereafter
0024                    *       while waiting for an interrupt which is driven by the
0025                    *       ignition pulse of one cyclinder on the engine. This
0026                    *       results in an interrupt upon each engine revolution.
0027                    *
0028                    *       The count between interrupts is inversly proportional
0029                    *       to the speed of the engine.  The 16 bit value of time
0030                    *       is used in subsequent tests to determine actions based
0031                    *       on engine speed.
0032                    *
0033                    *       If no ignition pulses are occuring, the micro loops
0034                    *       continuously, waiting and maintaining the outputs in
0035                    *       an off state.
0036                    *
0037                    *
0038                    *
0039                    * REV     DATE          BY                    REMARKS
0040                    * ---------------------------------------------------------------------
0041                    * 2.00    10-08-88      MATT WERNER           REWRITE
0042                    * 2.10    10-12-88      MATT WERNER           ADD SLEEP HOLD OFF
0043                    * 3.00    11-02-88      MATT WERNER           CLOSED LOOP RPM CONTROL
0044                    * 3.10    11-11-88      MATT WERNER           CHANGE FUEL SET POINTS
0045                    * 3.11    11-18-88      MATT WERNER           CHANGE DEAD ZONE SET POINTS
0046                    * 4.00    04-05-89      MATT WERNER           MOVE TO SIX CYLINDER
0047                    *                                             CHANGE SLEEP TO CUT OFF
0048                    *                                             MOVE DEAD ZONE SET POINTS
0049                    *                                             CHANGE FUEL SET POINTS
0050                    * 5.00    04-15-89      MATT WERNER           SAVE POINTS BASED ON LENGTH OF
0051                    *                                             CRANKING
0052                    * 5.10    04-18-89      MATT WERNER           ADD STARTUP ADVANCE POINTS
0053                    * 6.00    05-16-89      MATT WERNER           ADD TWO LEVEL SAVE POINTS
0054                    * 6.01    05-31-89      MATT WERNER           UPDATE COMMENTS AND ADD COPYRIGHT
0055                    *
0056                    *
0057                    ************************************************************************
0058                    ****       I/O Port Bit Assignments for 28pin version                 ****
0059                    ************************************************************************
0060                    *
0061                    *       PA0-7   UNUSED
0062                    *
0063                    *       PB0     ADV1        OUTPUT  SPARK ADVANCE 1
0064                    *       PB1     ADV2        OUTPUT  SPARK ADVANCE 2
0065                    *       PB2     ADV4        OUTPUT  SPARK ADVANCE 4
0066                    *       PB3     ADV8        OUTPUT  SPARK ADVANCE 8
0067                    *       PB4     SOL         OUTPUT  SOLENOID OUTPUT
0068                    *       PB5     BUG_I       OUTPUT  DEBUG BIT INT ROUTINE
0069                    *       PB6     BUG_M       OUTPUT  DEBUG BIT MAIN LOOP
0070                    *       PB7     UNUSED
0071                    *
0072                    *       PC0-4   UNUSED
0073                    *
mercgov.ASM
0075
0076                    *
0077                    ************************************************************************
0078                    ****       Register Definitions                                       ****
0079                    ************************************************************************
0080                    *
0081 0000                                   ORG     $00
0082
0083 0000 00            A_PORT:             FCB     $00
0084 0001 00            B_PORT:             FCB     $00
0085 0002 00            C_PORT:             FCB     $00
0086 0003 00                                FCB     $00
0087 0004 00            DDRA:               FCB     $00
0088 0005 00            DDRB:               FCB     $00
0089 0006 00            DDRC:               FCB     $00
0090 0007 00                                FCB     $00
0091 0008 00                                FCB     $00
0092 0009 00            TSCR:               FCB     $00
0093
0094
0095 0080                                   ORG     $80
0096
0097 0080 00            X:                  FCB     $00
0098 0081 00            Y:                  FCB     $00
0099
0100
0101 00fd                                   ORG     $FD
0102
```

```
0103 00fd 00                TPR:            FCB     $00
0104 00fe 00                TCR:            FCB     $00
0105 00ff 00                A:              FCB     $00
0106
0107
0108
0109                        *
0110                        ***************************************************************
0111                        ****        Variable Definitions                           ****
0112                        ***************************************************************
0113                        *
0114
0115 0082                                   ORG     $82
0116
0117 0082 00                HIGH_COUNT:     FCB     $00
0118 0083 00                LOW_COUNT:      FCB     $00
0119
0120 0084 00 00             TIME_COUNT:     FDB     $00
0121
0122 0086 00                ADVANCE:        FCB     $00
0123 0087 00                CUT_OFF_HOLD:   FCB     $00
0124 0088 00                ADV_BAND_PTR:   FCB     $00
0125 0089 00                FUEL_BAND_PTR:  FCB     $00
0126
mercgov.ASM
0128                        *
0129                        ***************************************************************
0130                        ****        Data Table Declarations                        ****
0131                        ***************************************************************
0132                        *
0133                        *     This table is used for testing against the RPM time value to
0134                        *  determine when certain events are to take place.  They are stored
0135                        *  in the data ROM area of the micro.
0136                        *
0137                        *
0138 0018                                   ORG     $18
0139
0140                        RPM_TABLE:
0141
0142                        LOW_FUEL:
0143 0018 03 3a                             FDB     $33A    520  RPM
0144 001a 03 32                             FDB     $332    525  RPM
0145                        HIGH_FUEL:
0146 001c 02 cc                             FDB     $2CC    600  RPM
0147 001e 02 af                             FDB     $2AF    625  RPM
0148                        FUEL_UP_SPEED:
0149 0020 02 19                             FDB     $219    800  RPM
0150                        FUEL_DN_SPEED:
0151 0022 02 f1                             FDB     $2F1    570  RPM
0152
0153                        IDLE_ADV:
0154 0024 02 c0                             FDB     $2C0    610  RPM
0155 0026 02 8a                             FDB     $28A    660  RPM
0156
0157                        WARM_UP_ADV:
0158 0028 02 8a                             FDB     $28A    660  RPM
0159 002a 02 35                             FDB     $235    760  RPM
0160
0161                        START_UP_ADV:
0162 002c 02 3d                             FDB     $23D    750  RPM
0163 002e 01 7e                             FDB     $17E    1125  RPM
0164
0165                        BOTTOM_SPEED:
0166 0030 05 ca                             FDB     $5CA    290  RPM  NO Fuel Point
0167
0168                        TOP_SPEED:
0169 0032 01 20                             FDB     $120    1500 RPM  Cut Off Point
0170
0171                        *
0172                        ***************************************************************
0173                        ****        Constant Definitions                           ****
0174                        ***************************************************************
0175                        *
0176
0177 0007                   TMZ_BIT:        EQU     $07
0178
0179 0000                   OPTO_1_BIT:     EQU     $00
0180 0001                   OPTO_2_BIT:     EQU     $01
0181 0002                   OPTO_4_BIT:     EQU     $02
0182 0003                   OPTO_8_BIT:     EQU     $03
0183 0004                   SOL_BIT:        EQU     $04
0184 0005                   DEBUG_I_BIT:    EQU     $05
0185 0006                   DEBUG_M_BIT:    EQU     $06
0186
0187 0010                   NUM_VARIABLES:  EQU     $10             number of bytes to init to zero
0188
0189 0006                   STALL_LIMIT:    EQU     $06             max value of RPM MSB (HIGH_COUNT)
0190 0008                   CUT_HOLD_INIT:  EQU     $08             number of highspeed revolutions required
0191                        *                                       for program cutout
0192
0193 002d                   START_TIMER:    EQU     $2D             timer control register start value
0194 0025                   STOP_TIMER:     EQU     $25             timer control register stop value
0195
0196 000e                   ADVANCE_INIT:   EQU     $0E             value of advance used after cranking begins
0197
0198 00a0                   START_TIME:     EQU     $A0             value of LSB rev couter at end of start up time
0199 0002                   TIME_OUT:       EQU     $02             value of MSB rev counter at end of warm up time
0200
0201                        *
0202                        ***************************************************************
0203                        ****        EPROM Options Register Declaration             ****
0204                        ***************************************************************
0205                        *
0206                        *     Sets Option Registor
0207                        *     For MC68704 Version Only    *
0208                        *
0209 0012                                   ORG     $12
0210
0211 0012 2c 2c 2c 2c 2c 2c EMOR:           FCB     $2C,$2C,$2C,$2C,$2C,$2C
0212
mercgov.ASM
0214                        ***************************************************************
0215                        ****     Copyright Notice to be burned into ROM            ****
0216                        ***************************************************************
0217                        *
0218                        *     ASCII Copyright notice that will be burned into the ROM of the
0219                        *     microprocessor.
0220                        *
0221
0222
0223 0e00                                   ORG     $E00
0224
0225 0e00 43                                FCB     'C
0226 0e01 4f                                FCB     'O
0227 0e02 50                                FCB     'P
0228 0e03 59                                FCB     'Y
0229 0e04 52                                FCB     'R
```

```
0230 0e05 49                    FCB   'I
0231 0e06 47                    FCB   'G
0232 0e07 48                    FCB   'H
0233 0e08 54                    FCB   'T
0234 0e09 20                    FCB   ' space
0235 0e0a 31                    FCB   '1
0236 0e0b 39                    FCB   '9
0237 0e0c 38                    FCB   '8
0238 0e0d 39                    FCB   '9
0239 0e0e 20                    FCB   ' space
0240 0e0f 57                    FCB   'W
0241 0e10 41                    FCB   'A
0242 0e11 4c                    FCB   'L
0243 0e12 42                    FCB   'B
0244 0e13 52                    FCB   'R
0245 0e14 4f                    FCB   'O
0246 0e15 20                    FCB   ' space
0247 0e16 43                    FCB   'C
0248 0e17 4f                    FCB   'O
0249 0e18 52                    FCB   'R
0250 0e19 50                    FCB   'P
0251 0e1a 4f                    FCB   'O
0252 0e1b 52                    FCB   'R
0253 0e1c 41                    FCB   'A
0254 0e1d 54                    FCB   'T
0255 0e1e 49                    FCB   'I
0256 0e1f 4f                    FCB   'O
0257 0e20 4e                    FCB   'N
0258
mercgov.ASM
0260                    *
0261                    ***********************************************************************
0262                    ****     MAIN PROGRAM                                              ****
0263                    ***********************************************************************
0264                    *
0265                    *     This is the main routine.  It runs at all times except when an
0266                    *  interrupt occurrs.
0267                    *
0268                    *     This routine
0269                    *        o   increments high order time count on each low order overflow
0270                    *        o   watches for engine stall i.e. no more interrupts
0271                    *
0272                    *     When the stall limit is reached the timer is reset, the solenoid
0273                    *  and optos are turned off, and the high order count is reset to zero.
0274                    *
0275                    *
0276
0277                    RESTART:
0278 0e21 8e 4b                 JSR     INITIALIZE
0279                    STALL_LOOP:
0280 0e23 b0 09 25              MVI     TSCR,#STOP_TIMER        turn off timer
0281 0e26 b0 fe ff              MVI     TCR,#$FF                set timer to start
0282 0e29 b0 09 2d              MVI     TSCR,#START_TIMER       turn on timer
0283 0e2c b0 88 2c              MVI     ADV_BAND_PTR,#START_UP_ADV preset adv. speed pointer
0284 0e2f b0 89 18              MVI     FUEL_BAND_PTR,#LOW_FUEL preset fuel speed pointer
0285 0e32 b0 85 00              MVI     TIME_COUNT+1,#$00       reset revolution counter
0286 0e35 b0 84 00              MVI     TIME_COUNT,#$00         "       "
0287 0e38 b0 86 0e              MVI     ADVANCE,#ADVANCE_INIT   preset adv. amount variable
0288 0e3b b0 01 08              MVI     B_PORT,#$08             half advance, fuel off
0289
0290                    TEST_TMZ:
0291 0e3e c7 09 fd              BRCLR   TMZ_BIT,TSCR,TEST_TMZ   wait for timer rollover
0292 0e41 aa                    INC     HIGH_COUNT              increment MSB of RPM counter
0293
0294 0e42 ae                    LDA     HIGH_COUNT              load MSB of RPM counter
0295 0e43 ec 06                 CMPA    #STALL_LIMIT            check for stalled engine
0296 0e45 78                    BLO     TEST_TMZ                NO,  go wait for timer rollover
0297
0298 0e46 b0 82 06              MVI     HIGH_COUNT,#STALL_LIMIT YES, hold MSB of RPM at max
0299 0e49 9e 23                 JMP     STALL_LOOP              go reset all variables
0300
0301                    *
0302                    *
0303                    ***********************************************************************
0304                    ****          Initialization Routine                               ****
0305                    ***********************************************************************
0306                    *
0307                    *     This routine
0308                    *        o   sets all port directions to out
0309                    *        o   sets the ram variables to zero
0310                    *        o   sets the hysteresis bit to on
0311                    *
0312                    *
0313
0314                    INITIALIZE:
0315 0e4b b0 04 ff              MVI     DDRA,#$FF
0316 0e4e b0 01 00              MVI     B_PORT,#$00             no advance, fuel off
0317 0e51 b0 05 ff              MVI     DDRB,#$FF
0318 0e54 b0 06 ff              MVI     DDRC,#$FF
0319
0320 0e57 b0 80 82              MVI     X,#HIGH_COUNT           load pointer to first variable
0321 0e5a b0 81 10              MVI     Y,#NUM_VARIABLES        number of variables
0322 0e5d e8 00                 LDA     #$00                    value to put in variables
0323                    ZERO_RAM:
0324 0e5f e1                    STA     [X]                     store value
0325 0e60 a8                    INC     X                       next variable
0326 0e61 b9                    DEC     Y                       decrement count
0327 0e62 1e                    BNE     ZERO_RAM                jump if not done
0328
0329 0e63 b2                    RTI                             return to main and enable interrupts
0330
0331
mercgov.ASM
0333                    *
0334                    ***********************************************************************
0335                    ****     INTERRUPT SERVICE MAIN ROUTINE                            ****
0336                    ***********************************************************************
0337                    *
0338                    *
0339                    *     This routine is initiated whenever the processor receives an
0340                    *  interrupt.  The interrupt occurrs once for every revolution of
0341                    *  the engine.  The timer is a down counter and the MSB of the RPM
0342                    *  count is an up counter.  The value of the timer is thus subtracted
0343                    *  from its maximum value to make it compatable with the up counter.
0344                    *
0345                    *     This routine
0346                    *        o   stops the hardware timer
0347                    *        o   saves the high order count value
0348                    *        o   computes and saves the low order count value
0349                    *        o   restarts the timer
0350                    *        o   calls the routine to test RPM and take action
0351                    *        o   returns to the main routine
0352                    *
0353                    *
0354
```

```
0355
0356 0e64 b0 09 25   INTERRUPT:
0357 0e67 fb ff                MVI     TSCR,#STOP_TIMER        stop timer
0358 0e69 fb fe                CLRA                            set accumulator to zero
0359 0e6b bf                   SUB     TCR                     subtract time from zero
0360 0e6c b0 fe ff             STA     LOW_COUNT               save as LSB of RPM counter
0361 0e6f b0 09 2d             MVI     TCR,#$FF                preset timer value to 255
0362                           MVI     TSCR,#START_TIMER       restart timer
0363 0e72 de 01                BSET    DEBUG_M_BIT,B_PORT      debug bit on
0364 0e74 8e 87                JSR     CHECK_TOP_SPEED         go check current RPM for actions
0365 0e76 d6 01                BCLR    DEBUG_M_BIT,B_PORT      debug bit off
0366
0367 0e78 f8 85                LDA     TIME_COUNT+1            increment engine rev counter LSB
0368 0e7a ea 01                ADD     #$01                    *
0369 0e7c f9 85                STA     TIME_COUNT+1            *
0370 0e7e 42                   BCC     EXIT_INT                if no overflow then go exit
0371 0e7f fe 84                INC     TIME_COUNT              else increment rev counter MSB
0372
0373 0e81 b0 82 00   EXIT_INT:
0374 0e84 fb ff                MVI     HIGH_COUNT,#$00         clear RPM count MSB to zero
0375 0e86 b2                   CLRA                            clear the accumulator
0376                           RTI                             return from interrupt
mercgov.ASM
0378                 *
0379                 ************************************************************
0380                 ****        RPM   TEST   ROUTINES                       ****
0381                 ****        PSUEDO CODE                                 ****
0382                 ************************************************************
0383                 *
0384                 *    This psuedo code follows the operation of the RPM test
0385                 *    routine that is called by the interrupt service routine.
0386                 *
0387                 *
0388                 *    IF RPM > Top_Speed (1678) THEN
0389                 *         IF sleep_hold <> 0 THEN
0390                 *              sleep_hold = sleep_hold - 1
0391                 *         ELSE
0392                 *              fuel_solenoid = OFF
0393                 *              advance_output = 0
0394                 *              advance_var = 0
0395                 *              time_count = MAX
0396                 *              RETURN
0397                 *         ENDIF
0398                 *    ENDIF
0399                 *
0400                 *    sleep_hold = hold_init
0401                 *
0402                 *    IF RPM < Bottom_Speed (290) THEN
0403                 *         fuel_solenoid = OFF
0404                 *         advance_output = $08
0405                 *         advance_var = $0F
0406                 *         RETURN
0407                 *    ENDIF
0408                 *
0409                 *    IF time_count > Start_Time THEN
0410                 *         advance_ptr = Warm_Up_Adv
0411                 *         RETURN
0412                 *    ENDIF
0413                 *
0414                 *    IF time_count > Warm_Time THEN
0415                 *         advance_ptr = Idle_Adv
0416                 *         fuel_ptr = Low_Fuel
0417                 *         time_count = MAX
0418                 *    ELSEIF RPM > Fuel_Up_Speed THEN
0419                 *         fuel_ptr = High_Fuel
0420                 *    ELSEIF RPM < Fuel_Down_Speed THEN
0421                 *         fuel_ptr = Low_Fuel
0422                 *    ELSEIF RPM < fuel_ptr(ON) THEN
0423                 *         fuel_solenoid = ON
0424                 *    ENDIF
0425                 *
0426                 *    IF RPM > fuel_ptr(OFF) THEN
0427                 *         fuel_solenoid = OFF
0428                 *    ENDIF
0429                 *
0430                 *    IF RPM < advance_ptr(LOW) THEN
0431                 *         IF advance_var < 15 THEN
0432                 *              advance_var = advance_var + 1
0433                 *         ENDIF
0434                 *    ELSEIF RPM > advance_ptr(HIGH) THEN
0435                 *         IF advance_var > 0 THEN
0436                 *              advance_var = advance_var - 1
0437                 *         ENDIF
0438                 *    ENDIF
0439                 *
0440                 *    advance_output = advance_var
0441                 *
mercgov.ASM
0443                 ********************************************************************
0444                 ****        RPM TESTING ROUTINES                                ****
0445                 ********************************************************************
0446
0447
0448 0e87 e8 32      CHECK_TOP_SPEED:
0449 0e89 8f 1f                LDA     #TOP_SPEED
0450 0e8b 62                   JSR     RPM_TEST
0451 0e8c 9e a1                BLO     IS_TOP_SPEED
0452                           JMP     SET_HOLD
0453 0e8e f8 87      IS_TOP_SPEED:
0454 0e90 24                   LDA     CUT_OFF_HOLD
0455 0e91 ff 87                BEQ     CUT_OFF
0456 0e93 9e a4                DEC     CUT_OFF_HOLD
0457                           JMP     CHECK_BOT_SPEED
0458 0e95 f8 01      CUT_OFF:
0459 0e97 ed e0                LDA     B_PORT
0460 0e99 f9 01                AND     #$E0
0461 0e9b b0 86 00             STA     B_PORT
0462 0e9e b0 84 02             MVI     ADVANCE,#$00
0463                           MVI     TIME_COUNT,#TIME_OUT
0464 0ea1 b0 87 08   SET_HOLD:
0465                           MVI     CUT_OFF_HOLD,#CUT_HOLD_INIT
0466
0467 0ea4 e8 30      CHECK_BOT_SPEED:
0468 0ea6 8f 1f                LDA     #BOTTOM_SPEED
0469 0ea8 6c                   JSR     RPM_TEST
0470 0ea9 b0 86 0e             BLO     CHECK_START_TIME
0471 0eac f8 01                MVI     ADVANCE,#ADVANCE_INIT
0472 0eae ed e0                LDA     B_PORT
0473 0eb0 ea 08                AND     #$E0
0474 0eb2 f9 01                ADD     #$08
0475 0eb4 b3                   STA     B_PORT
0476                           RTS
0477
0478 0eb5 f8 84      CHECK_START_TIME:
0479 0eb7 08                   LDA     TIME_COUNT
0480 0eb8 f8 85                BNE     CHECK_WARM_TIME
0481 0eba ec a0                LDA     TIME_COUNT+1
0482 0ebc 03                   CMP     #START_TIME
                               BNE     CHECK_WARM_TIME
```

```
0483 0ebd b0 88 28                    MVI     ADV_BAND_PTR,#WARM_UP_ADV
0484
0485                  CHECK_WARM_TIME:
0486 0ec0 f8 84                       LDA     TIME_COUNT
0487 0ec2 ec 02                       CMP     #TIME_OUT
0488 0ec4 6b                          BLO     CHECK_FUEL_UP
0489 0ec5 b0 88 24                    MVI     ADV_BAND_PTR,#IDLE_ADV
0490 0ec8 b0 89 18                    MVI     FUEL_BAND_PTR,#LOW_FUEL
0491 0ecb b0 84 02                    MVI     TIME_COUNT,#TIME_OUT
0492 0ece 9e e7                       JMP     CHECK_OFF
0493
0494 0ed0 e8 20                       LDA     #FUEL_UP_SPEED
0495 0ed2 8f 1f                       JSR     RPM_TEST
0496 0ed4 43                          BHS     CHECK_FUEL_DN
0497 0ed5 b0 89 1c                    MVI     FUEL_BAND_PTR,#HIGH_FUEL
0498
0499 0ed8 e8 22                       LDA     #FUEL_DN_SPEED
0500 0eda 8f 1f                       JSR     RPM_TEST
0501 0edc 63                          BLO     CHECK_SAVE
0502 0edd b0 89 18                    MVI     FUEL_BAND_PTR,#LOW_FUEL
0503
0504
0505 0ee0 f8 89                       LDA     FUEL_BAND_PTR
0506 0ee2 8f 1f                       JSR     RPM_TEST
0507 0ee4 62                          BLO     CHECK_OFF
0508 0ee5 dc 01                       BSET    SOL_BIT,B_PORT
0509
0510 0ee7 f8 89                       LDA     FUEL_BAND_PTR
0511 0ee9 ea 02                       ADD     #$02
0512 0eeb 8f 1f                       JSR     RPM_TEST
0513 0eed 42                          BHS     CHECK_LOWER_BAND
0514 0eee d4 01                       BCLR    SOL_BIT,B_PORT
0515
0516                  *
mercgov.ASM
0518                  *
0519
0520                  CHECK_LOWER_BAND:
0521 0ef0 f8 88                       LDA     ADV_BAND_PTR
0522 0ef2 8f 1f                       JSR     RPM_TEST
0523 0ef4 42                          BHS     CHECK_ADV_HIGH
0524 0ef5 9f 02                       JMP     CHECK_UPPER_BAND
0525                  CHECK_ADV_HIGH:
0526 0ef7 f8 86                       LDA     ADVANCE
0527 0ef9 ec 0f                       CMP     #$0F
0528 0efb 02                          BNE     INCR_ADVANCE
0529 0efc 9f 14                       JMP     WRITE_ADVANCE
0530                  INCR_ADVANCE:
0531 0efe fe ff                       INC     A
0532 0f00 9f 14                       JMP     WRITE_ADVANCE
0533
0534                  CHECK_UPPER_BAND:
0535 0f02 f8 88                       LDA     ADV_BAND_PTR
0536 0f04 ea 02                       ADD     #$02
0537 0f06 8f 1f                       JSR     RPM_TEST
0538 0f08 64                          BLO     CHECK_ADV_LOW
0539 0f09 f8 86                       LDA     ADVANCE
0540 0f0b 9f 14                       JMP     WRITE_ADVANCE
0541                  CHECK_ADV_LOW:
0542 0f0d f8 86                       LDA     ADVANCE
0543 0f0f 02                          BNE     DECR_ADVANCE
0544 0f10 9f 14                       JMP     WRITE_ADVANCE
0545                  DECR_ADVANCE:
0546 0f12 ff ff                       DEC     A
0547                  WRITE_ADVANCE:
0548 0f14 f9 86                       STA     ADVANCE
0549 0f16 f8 01                       LDA     B_PORT
0550 0f18 ed f0                       AND     #$F0
0551 0f1a fa 86                       ADD     ADVANCE
0552 0f1c f9 01                       STA     B_PORT
0553 0f1e b3                          RTS
0554
mercgov.ASM
0556
0557                  *
0558                  ***********************************************************************
0559                  ****     RPM Test Routine                                            ****
0560                  ***********************************************************************
0561                  *
0562                  *  Before calling this routine, the calling program should load the
0563                  *  accumulator with the pointer to the RPM test value.  The HIGH_COUNT
0564                  *  and LOW_COUNT values are tested against the RPM values pointed to
0565                  *  by the Accumulator.  The routine will return with the Carry Bit
0566                  *  set or cleared based on the values tested.
0567                  *
0568                  *   Carry Set:     IF RPM <  Table Value
0569                  *
0570                  *   Carry Clear:   IF RPM >= Table Value
0571                  *
0572
0573                  RPM_TEST:
0574 0f1f bc                          TAX                     move RPM pointer to index reg.
0575 0f20 ae                          LDA     HIGH_COUNT      load RPM MSB
0576 0f21 e4                          CMP     [X]             compare with MSB table value
0577 0f22 03                          BNE     EXIT_RPM_TEST   if not equal then go exit
0578 0f23 a8                          INCX                    else increment pointer
0579 0f24 af                          LDA     LOW_COUNT       load RPM LSB
0580 0f25 e4                          CMP     [X]             compare with LSB table value
0581                  EXIT_RPM_TEST:
0582 0f26 b3                          RTS                     return to calling routine
0583
0584
0585
0586
0587                  *
0588                  ***********************************************************************
0589                  ****     VECTOR  TABLE                                               ****
0590                  ***********************************************************************
0591                  *
0592                  *    The following are the reset and interrupt vectors as defined for
0593                  *    the MC6804 microprocessor.
0594                  *
0595
0596 0ffc                             ORG     $FFC
0597
0598 0ffc 9e 64       INT_VECT:       JMP     INTERRUPT       start of interrupt service routine
0599 0ffe 9e 21       RESET_VECT:     JMP     RESTART         start of main program
0600
0601                  *
0602                  ***********************************************************************
0603                  ****     END OF PROGRAM                                              ****
0604                  ***********************************************************************
0605                  *
0606                  *
```

We claim:

1. An automatic fuel enrichment system for cranking and warm-up of an internal combustion engine that includes a fuel supply, means responsive to application of electrical power for selectively feeding enrichment fuel from said supply to said engine, and means for controlling said power-responsive means; characterized in that said controlling means comprises:

means for measuring speed of said engine and supplying an electrical engine-speed signal as a function of engine r.p.m., and means responsive to engine speed for selectively applying electrical power to said power-responsive means, and thereby selectively energizing and de-energizing said power-responsive means, to feed enrichment fuel from said supply to said engine as a predetermined function of engine speed, said speed-responsive means comprising means for comparing said speed signal to a first signal threshold corresponding to minimum cranking speed of said engine for energizing said power-responsive means and feeding enrichment fuel to said engine during cranking, and means for comparing said speed signal to a second signal threshold corresponding to idle speed of said engine for de-energizing said power-responsive means and terminating delivery of enrichment fuel during cranking.

2. The system set forth in claim 1 wherein said speed-responsive means further comprises means for comparing said speed signal to a third signal threshold corresponding to an engine speed between said minimum cranking speed and said idle speed for energizing said power-responsive means and thereby feeding enrichment fuel to said engine to prevent engine stall during warm-up.

3. The system set forth in claim 2 wherein said means for comparing said speed signal to said second and third thresholds comprises means having hysteresis corresponding to a difference between said second and third thresholds.

4. The system set forth in claim 1 further comprising means for variably setting each of said first and second signal thresholds.

5. The system set forth in claim 1 further comprising means for comparing said speed signal to a threshold corresponding to minimum running speed of said engine to de-energize said power-responsive means and thereby terminate supply of enrichment fuel in the event of engine stall.

6. The system set forth in claim 1 further comprising means responsive to absence of said speed signal for de-energizing said power-responsive means and thereby terminating supply of enrichment fuel in the event of engine stall.

7. The system set forth in claim 1 wherein said power-responsive means comprises a solenoid valve.

8. The system set forth in claim 1 wherein said means for measuring engine speed comprises means coupled to said engine for generating signal pulses as a direct function of engine speed, and a frequency-to-voltage convertor responsive to said signal pulses to provide said speed signal as a d.c. analog signal which varies with engine speed.

9. The system set forth in claim 8 wherein said frequency-to-voltage convertor comprises a sawtooth signal generator having a reset input responsive to said signal pulses and providing a ramp signal which varies as a function of time between said signal pulses, and a sample-and-hold circuit for sampling peak values of said ramp signal and supplying such peak values as said speed signal.

10. The system set forth in claim 9 wherein said sample-and-hold circuit has a signal input connected to receive said ramp signal and a control input connected to receive said signal pulses.

11. The system set forth in claim 1 wherein said means for measuring speed comprises means coupled to said engine for generating signal pulses as a direct function of engine speed, and microprocessor-based control means including means responsive to said signal pulses to provide said speed signal.

12. The system set forth in claim 11 wherein said microprocessor-based control means further includes means for selectively controlling ignition angle at said engine as a function of engine speed.

13. The system set forth in claim 12 wherein said angle-controlling means comprises means for controlling ignition angle in discrete steps as a function of engine speed.

14. The system set forth in claim 1 further comprising means coupled to the engine and responsive to engine temperature for inhibit operation of said power-responsive means.

15. An automatic fuel enrichment system for an internal combustion engine that includes a fuel supply, means responsive to application of electrical power for selectively feeding enrichment fuel from said supply to said engine, and means for controlling said power-responsive means; characterized in that said controlling means comprises:

means for supplying an electrical engine-speed signal as a function of engine r.p.m., means for comparing said speed signal to a first signal threshold corresponding to a first speed of said engine for energizing said power-responsive means and feeding enrichment fuel to said engine, means for comparing said speed signal to a second signal threshold corresponding to a second speed of said engine greater than said first speed for de-energizing said power-responsive means and terminating delivery of enrichment fuel, and means for comparing said speed signal to a third signal threshold corresponding to a third engine speed between said first and second speeds for energizing said power-responsive means and thereby feeding enrichment fuel to said engine to prevent engine stall.

16. The system set forth in claim 15 wherein said controlling means further comprises means for selectively controlling ignition angle at said engine as a function of engine speed.

17. An automatic fuel enrichment system for an internal combustion engine that includes a fuel supply, means responsive to application of electrical power for selectively feeding enrichment fuel from said supply to said engine, and means for controlling said power-responsive means; characterized in that said controlling means comprises:

means for supplying an electrical engine-speed signal as a function of engine r.p.m., means for comparing said speed signal to a first signal threshold corresponding to a first speed of said engine for energizing said power-responsive means and feeding enrichment fuel to said engine, means for comparing said speed signal to a second signal threshold corresponding to a second speed of said engine greater than said first speed for de-energizing said power-responsive means and terminating delivery of enrichment fuel, means for selectively controlling ignition angle at said engine as a function of engine speed, and means for comparing said speed signal to a third signal threshold corresponding to a third engine speed between said first and second speeds for energizing said power-responsive means and thereby feeding enrichment fuel to said engine to prevent engine stall.

18. An automatic fuel enrichment system for an internal combustion engine that includes means for varying ignition advance angle, a fuel supply, means responsive to application of electrical power for selectively feeding enrichment fuel from said supply to said engine, and means for controlling said power-responsive means; characterized in that said controlling means comprises:

means for supplying an electrical engine-speed signal as a function of engine r.p.m., means for comparing said speed signal to a first signal threshold corresponding to a first speed of said engine for energizing said power-responsive means and feeding enrichment fuel to said engine, means for comparing said speed signal to a second signal threshold corresponding to a second speed of said engine greater than said first speed for de-energizing said power-responsive means and terminating delivery of enrichment fuel, means coupled to said ignition advance angle varying means for comparing said speed signal to a third threshold automatically to increase advance angle at said ignition advance angle varying means when said speed signal decreases below said third threshold, and means responsive to said speed signal for detecting an increase in said speed signal above a fourth threshold following a decrease below said third threshold, and means coupled to said advance varying means and responsive to said increase-detecting means for automatically decreasing ignition advance angle at said ignition advance angle varying means.

19. The system set forth in claim 18 wherein said means means coupled to said angle varying comprises means for selectively decreasing and increasing ignition advance angle at the engine in discrete steps as a function of engine speed.

20. A system for controlling ignition angle and fuel enrichment during warm-up of an internal combustion engine, said engine having a fuel supply, means responsive to application of electrical power for selectively feeding fuel from said supply to the engine, and means for controlling advance angle of ignition at the engine, said system comprising:

means for sensing engine speed and providing an electrical speed signal as a function thereof, means responsive to said speed signal for comparing engine speed to first, second and third thresholds respectively corresponding to first, second and third speeds at said engine, means coupled to said ignition angle control means and responsive to said comparing means for automatically increasing advance angle at the ignition control when engine speed decreases below said first threshold speed, means coupled to said advance angle controlling means and responsive to said comparing means for automatically decreasing engine advance angle when engine speed exceeds said second threshold speed greater than said first threshold speed following a decrease in engine speed below said first threshold, and means for energizing said power-responsive means and feeding fuel to the engine when engine speed is below said third threshold speed.

21. The system set forth in claim 20 wherein said advance angle controlling means comprises means for selectively decreasing and increasing advance angle in discrete angular increments as a function of engine speed.

22. The system set forth in claim 21 wherein said advance angle controlling means comprises means for selectively decreasing and increasing advance angle by one said discrete angular increment upon each revolution of said engine.

23. The system set forth in claim 20 further comprising means for comparing said speed signal to a fourth threshold, and means for de-energizing and power-responsive means and terminating fuel delivery when said speed signal exceeds said fourth threshold.

24. The system set forth in claim 23 further comprising means for inhibiting operation of said power-responsive means after a preselected duration of engine operation.

25. The system set forth in claim 24 further comprising means for measuring said duration as a preselected number of engine cycles.

26. The system set forth in claim 20 further comprising means coupled to the engine and responsive to engine temperature for inhibit operation of said power-responsive means.

27. A system for controlling ignition angle of an internal combustion engine having means for controlling ignition angle in discrete angular increments, said system comprising:

means for sensing engine speed, means responsive to said sensing means for comparing engine speed to a first threshold speed and to a second threshold speed greater than said first threshold speed, means coupled to said comparing means for increasing angle of ignition advance by one of said angular increments upon each revolution of the engine when engine speed is less than said first threshold speed, and means coupled to said comparing means for decreasing angle of ignition advance by one of said angular increments upon each revolution of the engine when engine speed is greater than said second threshold speed, such that there is an engine speed deadband between said first and second speed thresholds within which ignition advance angle remains constant.

28. The system set forth in claim 27 further comprising means for decreasing said first and second speed thresholds, while maintaining said second threshold speed greater than said first threshold speed, after a preselected duration of engine operation.

29. The system set forth in claim 28 further comprising means for measuring said duration as a preselected number of engine cycles.

30. The system set forth in claim 27 further comprising means for fuel enrichment at said engine during warm-up including:

a fuel supply, means responsive to application of electrical power for delivering fuel from said supply to the engine, means for comparing engine speed to a third threshold speed, and means for applying electrical power to said power-responsive means when engine speed is less than said third threshold speed.

31. The system set forth in claim 30 wherein said power-responsive means comprises a solenoid valve.

* * * * *